US010843851B2

(12) United States Patent
Han

(10) Patent No.: US 10,843,851 B2
(45) Date of Patent: Nov. 24, 2020

(54) CONTAINER FOR HAIR TONIC

(71) Applicant: DTS MG Co., Ltd, Seoul (KR)

(72) Inventor: Ki Soo Han, Seoul (KR)

(73) Assignee: DTS MG CO., LTD, Seoul (KR)

( * ) Notice: Subject to any disclaimer, the term of this patent is extended or adjusted under 35 U.S.C. 154(b) by 104 days.

(21) Appl. No.: 16/381,115

(22) Filed: Apr. 11, 2019

(65) Prior Publication Data

US 2020/0017262 A1 Jan. 16, 2020

(30) Foreign Application Priority Data

Jul. 13, 2018 (KR) ..... 10-2018-0081634

(51) Int. Cl.
*B65D 47/24* (2006.01)
*A45D 19/16* (2006.01)
*B65D 47/12* (2006.01)

(52) U.S. Cl.
CPC ..... *B65D 47/248* (2013.01); *A45D 19/16* (2013.01); *B65D 47/122* (2013.01)

(58) Field of Classification Search
CPC ..... A45D 19/16; A45D 24/22; A45D 24/24; A45D 24/26; A45D 24/28; A45D 34/045; A45D 34/043; A45D 34/042; A45D 34/34; A45D 34/041; A45D 2019/0033; B65D 47/248; B65D 47/122
See application file for complete search history.

(56) References Cited

U.S. PATENT DOCUMENTS 738,455 A * 9/1903 King ..... A46B 11/0013 401/273
774,553 A * 11/1904 Boon ..... A46B 11/0013 401/273
893,635 A * 7/1908 Marquart ..... A46B 11/0013 401/273
1,185,760 A * 6/1916 Berry ..... B43K 5/1845 401/206
1,992,607 A * 2/1935 De Mille ..... A46B 11/0013 401/273
2,162,907 A * 6/1939 Bambach ..... A46B 11/0027 401/28
2,493,990 A * 1/1950 Morgadanes ..... A46B 11/0013 401/273

(Continued)

FOREIGN PATENT DOCUMENTS

KR 10-2010-0108891 10/2010

*Primary Examiner* — Nicholas D Lucchesi
(74) *Attorney, Agent, or Firm* — Lex IP Meister, PLLC

(57) ABSTRACT

Disclosed is a container for a hair tonic, wherein a nozzle hole (21) is formed at a center inside a lid (20) coupled to an upper portion of a container main body (10), and an assembly hole (31) is formed at a center of a scalp stimulation means (30) coupled to an upper portion of the lid such that a nozzle opening and closing means (40) protrudes above the scalp stimulation means to be operated under pressure while compressing an elastic spring when the scalp is tapped, wherein an inclined portion (21*a*) having a taper shape outside the nozzle hole is normally in linear contact with an outer edge of a blocking plate (44) at a lower portion of the nozzle opening and closing means for tight sealing, but nozzle opening operation is quickly performed to discharge a medicinal fluid when the nozzle opening and closing means is operated under pressure.

3 Claims, 6 Drawing Sheets

(56) References Cited

U.S. PATENT DOCUMENTS

| | | | | | |
|---|---|---|---|---|---|
| 2,939,615 | A * | 6/1960 | Lerner | B65D 47/44 | 222/207 |
| 3,628,876 | A * | 12/1971 | Casey | B43K 5/1845 | 401/138 |
| 4,139,124 | A * | 2/1979 | Ferrante | B65D 83/0094 | 222/110 |
| 4,966,484 | A * | 10/1990 | Kimura | A45D 34/042 | 401/273 |
| 4,973,183 | A * | 11/1990 | Shevick | A47K 5/1201 | 222/453 |
| 5,018,894 | A * | 5/1991 | Goncalves | A45D 34/04 | 401/202 |
| 5,567,073 | A * | 10/1996 | de Laforcade | A45D 34/04 | 401/190 |
| 6,145,513 | A * | 11/2000 | Chu | A45D 19/02 | 132/112 |
| 6,210,064 | B1 * | 4/2001 | White | A46B 11/0013 | 401/279 |
| 6,672,314 | B2 * | 1/2004 | Vayrette | A45D 19/02 | 132/111 |
| 7,874,300 | B2 * | 1/2011 | Roeder | A45D 40/28 | 132/320 |
| 8,499,985 | B2 * | 8/2013 | Lehmkuhl | B65D 41/0471 | 222/525 |
| 9,807,975 | B2 * | 11/2017 | Buchholz | A01J 11/04 | |
| 10,285,494 | B1 * | 5/2019 | Lho | A46B 11/002 | |
| 10,323,763 | B2 * | 6/2019 | Cormier | F16K 15/026 | |
| 2014/0096786 | A1 * | 4/2014 | Nuzzo | A45D 7/00 | 132/207 |
| 2017/0295903 | A1 * | 10/2017 | Coffee | A45D 24/22 | |
| 2018/0027942 | A1 * | 2/2018 | Jeon | A61H 23/06 | |

* cited by examiner

CONTAINER FOR HAIR TONIC

CROSS REFERENCE TO RELATED APPLICATION

The present application claims priority to Korean Patent Application No. 10-2018-0081634, filed Jul. 13, 2018, the entire contents of which is incorporated herein for all purposes by this reference.

BACKGROUND OF THE INVENTION

Field of the Invention

The present invention relates generally to a container for a hair tonic. More particularly, the present invention relates to a container for a hair tonic having scalp stimulation protrusions, in which a nozzle hole is opened by tapping the scalp so that the hair tonic is discharged and the scalp is stimulated simultaneously, and thus, blood circulation and hair tonic absorption are promoted, thereby helping to prevent hair loss and promote hair growth.

Description of the Related Art

As is well known, the scalp of a person generally consists of epidermis, dermis, and subcutaneous tissue like skin tissues, but unlike other skin tissues, the scalp is supplied with excess oil from sebaceous glands, hair follicles producing hair are distributed on the scalp, and a hair cycle is formed by the keratinocyte cells in the hair follicle, causing hair growth and loss.

Natural growth and loss of hair occur repeatedly. When the number of falling hairs is more than the number of growing hairs, it is referred to as a hair loss problem, and the hair loss problem may be suspected if more than 80 hairs are lost per day.

In particular, many people in modern times are suffering hair loss due to various factors and often become bald. These hair loss phenomena may be caused by various pollutants, excessive stress, or genetic factors, but also may be caused by weakened hair follicles due to perms, dyeing, mousse, or sprays.

Therefore, various methods have been proposed to prevent the progression of hair loss. As an example, a method in which a scalp tonic contained in a container is injected into the scalp by a discharging means, and thus expands veins of a subcutaneous layer containing hair follicles in the scalp and/or supplies nutrients to hair has been proposed.

Here, to more efficiently realize the effects of the scalp tonic in the conventional method, the scalp is typically massaged with fingers or by lightly tapping the scalp with a separate massage tool after applying the scalp tonic to the scalp. However, this method is problematic in that a user has to use a medicinal fluid container and a massage tool separately, which is inconvenient.

In an effort to solve the problem of the related art, in Korean Patent Application Publication No. 10-2010-0108891 and the like, there have been disclosed products in which a discharging means and a massage tool such as a brush are integrally coupled to the upper portion of a container containing a scalp tonic so as to massage the scalp while applying a medicinal fluid to the scalp. However, when the scalp is tapped with the upper portion of the container, that is, when the discharging means and the massage tool of the upper portion of the container are brought into contact with the scalp, nozzle opening operation is not performed quickly, the medicinal fluid is not smoothly discharged, a desired amount of medicinal fluid is not dispensed well, and the medicinal fluid is not evenly distributed to the scalp, resulting in poor efficiency of use. Another problem of the above-mentioned products resides in that the medicinal fluid may leak from a container due to a poor sealing structure, thereby causing inconvenience to a user.

In addition, the conventional container has a structure in which a large number of parts are assembled in a complicated manner, so the manufacturing and assembling productivity is lowered, resulting in an increase in the manufacturing cost and lowering of the product competitiveness.

The foregoing is intended merely to aid in the understanding of the background of the present invention, and is not intended to mean that the present invention falls within the purview of the related art that is already known to those skilled in the art.

DOCUMENTS OF RELATED ART (Document 1) Korean Patent Application Publication No. 10-2010-0108891

SUMMARY OF THE INVENTION

Accordingly, the present invention has been made keeping in mind the above problems occurring in the related art, and an object of the present invention is to provide a container for a hair tonic, in which the container is configured such that when a nozzle opening and closing means provided at the centers of both a lid coupled to the upper portion of a container main body and a scalp stimulation means coupled to the upper portion of the lid taps the scalp, the nozzle opening and closing means is pressed and a medicinal fluid is discharged, wherein the container has a sealing structure for normally preventing leakage of the medicinal fluid, but when the nozzle opening and closing means taps the scalp, nozzle opening operation is quickly performed so as to discharge the medicinal fluid, and thus, not only the medicinal fluid is smoothly discharged to the scalp but also is dispersed and evenly discharged in all directions, whereby use efficiency is greatly improved.

Another object of the present invention is to provide a container for a hair tonic, in which a lid, a scalp stimulation means, and a nozzle opening and closing means are formed in a simple structure, as well as an assembly structure thereof is simply formed, thereby improving manufacturing productivity, assembly productivity and economic feasibility.

In order to achieve the above object, according to one aspect of the present invention, there is provided a container for a hair tonic, in which the container is provided with scalp stimulation protrusions that stimulate the scalp while discharging a medicinal fluid as a nozzle hole is opened by tapping a scalp stimulation means provided at an upper portion of a lid coupled to an upper portion of a container main body on the scalp, wherein the nozzle hole is formed at a center of a partition wall inside the lid; the scalp stimulation means is coupled to the upper portion of the lid, with an assembly hole formed at a center of the scalp stimulation means, a plurality of scalp stimulation protrusions protrudingly provided on the scalp stimulation means, and medicinal fluid discharge holes formed outside the assembly hole so as to disperse and discharge the medicinal fluid; and a nozzle opening and closing means protrudes above the scalp stimulation means through both the nozzle hole of the lid and the assembly hole of the scalp stimulation means, the nozzle opening and closing means being insertedly provided in the lid to be operated under pressure while compressing an elastic spring when tapping the scalp stimulation means on the scalp, wherein the partition wall of the lid is provided at a position around the nozzle hole with an inclined portion having a taper shape, and a lower portion of the nozzle opening and closing means is provided with a blocking plate such that an outer edge of the blocking plate is normally in linear contact with the inclined portion for tight sealing, and nozzle opening operation is quickly performed when the nozzle opening and closing means is operated under pressure.

The nozzle opening and closing means may include: a first member inserted through the assembly hole of the scalp stimulation means; and a second member inserted through the nozzle hole of the lid and provided with the blocking plate at a lower portion thereof, the first and second members being coupled together to be arranged on top of one another, and the elastic spring may be placed between a lower portion of the first member and the partition wall inside the lid to elastically support the first member.

The second member may be provided at circumferentially equiangular positions on an outer circumferential surface thereof with medicinal fluid discharge guide grooves for dispersing and discharging the medicinal fluid in vertical directions.

According to the present invention, it is advantageous in that the nozzle hole is formed at the center inside the lid coupled to an upper portion of the container main body, the assembly hole is formed at the center of the scalp stimulation means coupled to an upper portion of the lid such that the nozzle opening and closing means protrudes above the scalp stimulation means to be operated under pressure while compressing an elastic spring when the scalp is tapped, the inclined portion having a taper shape outside the nozzle hole is normally in linear contact with an outer edge of the blocking plate at a lower portion of the nozzle opening and closing means for tight sealing, and nozzle opening operation is quickly performed to discharge a medicinal fluid when the scalp is tapped and thus the nozzle opening and closing means is operated under pressure. Thus, the medicinal fluid is dispersed and evenly discharged in all directions through a plurality of medicinal fluid discharge holes formed at the circumference of the scalp stimulation means via the medicinal fluid discharge guide grooves and the inclined portion—the nozzle hole at the center of the lid, whereby use efficiency is excellent.

In particular, normally, the sealing effect between the blocking plate of the nozzle opening and closing means and the inclined portion is excellent, so the leakage of the medicinal fluid is prevented. However, when the nozzle opening and closing means taps the scalp, nozzle opening operation is quickly performed so as to discharge a desired amount of the medicinal fluid, thereby improving user satisfaction.

In addition, the lid coupled to the upper portion of the container main body, the scalp stimulation means, and the nozzle opening and closing means are formed in a simple structure, as well as an assembly structure thereof is simply formed, thereby improving manufacturing productivity, assembly productivity, and economic feasibility.

BRIEF DESCRIPTION OF THE DRAWINGS

The above and other objects, features and other advantages of the present invention will be more clearly understood from the following detailed description when taken in conjunction with the accompanying drawings, in which:

FIGS. 5 and 6 are sectional views showing an operating state of the present invention, wherein FIG. 5 shows a state before contact with the scalp, and FIG. 6 shows a state of contact with the scalp.

DETAILED DESCRIPTION OF THE INVENTION

Hereinbelow, an exemplary embodiment of the present invention will be described in detail with reference to the accompanying drawings.

Figure 1:
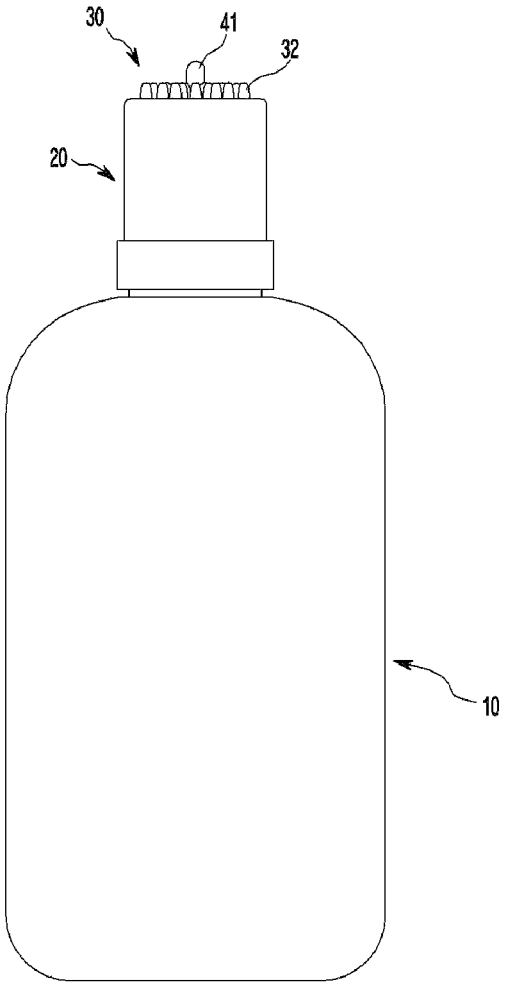
FIG. 1 is a front view showing a state where the present invention is coupled to a container main body.
Figure 2:
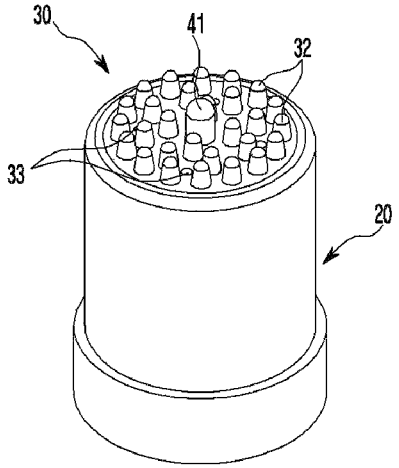
FIG. 2 is a perspective view of an important portion showing the present invention.
Figure 3:
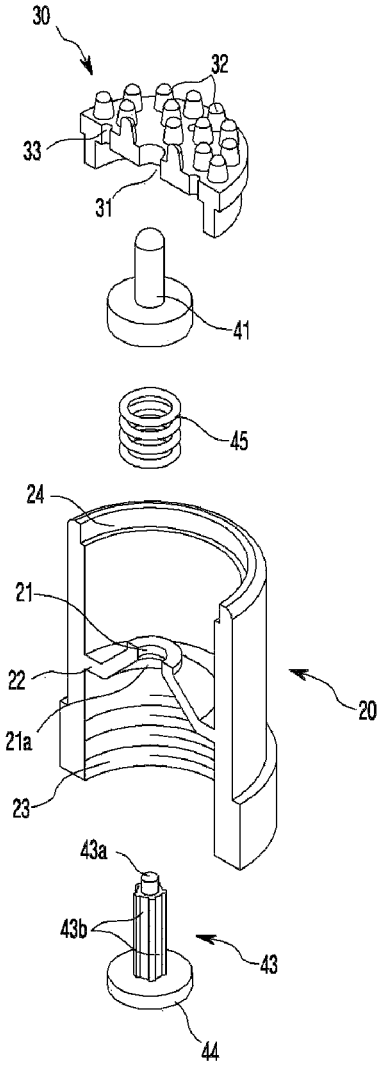
FIG. 3 is an exploded perspective view of FIG. 2.
Figure 4:
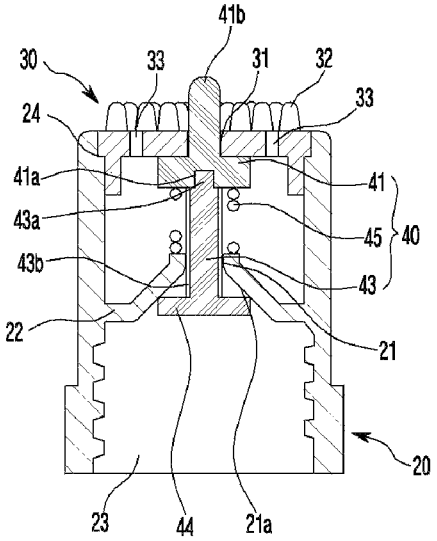
FIG. 4 is a sectional view of FIG. 2.
Figure 5:
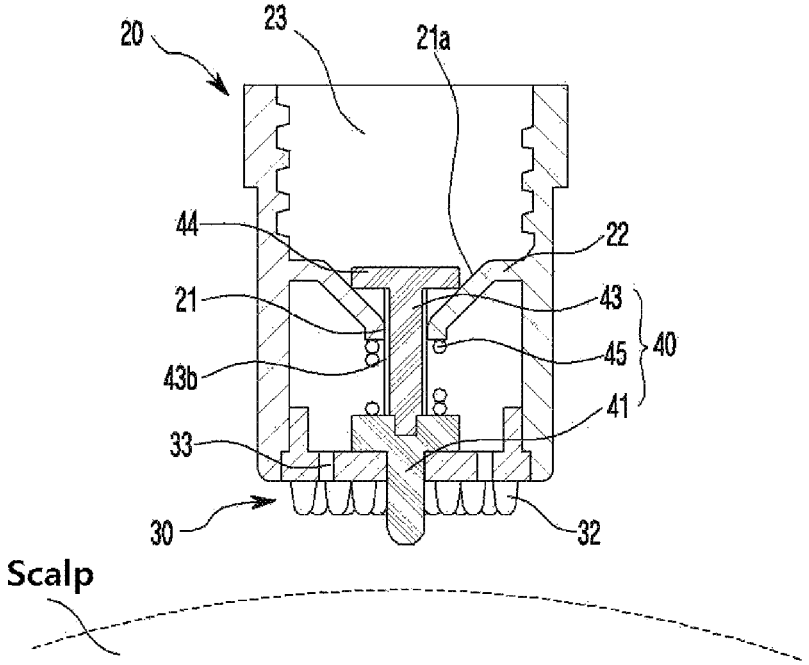
Figure 6:
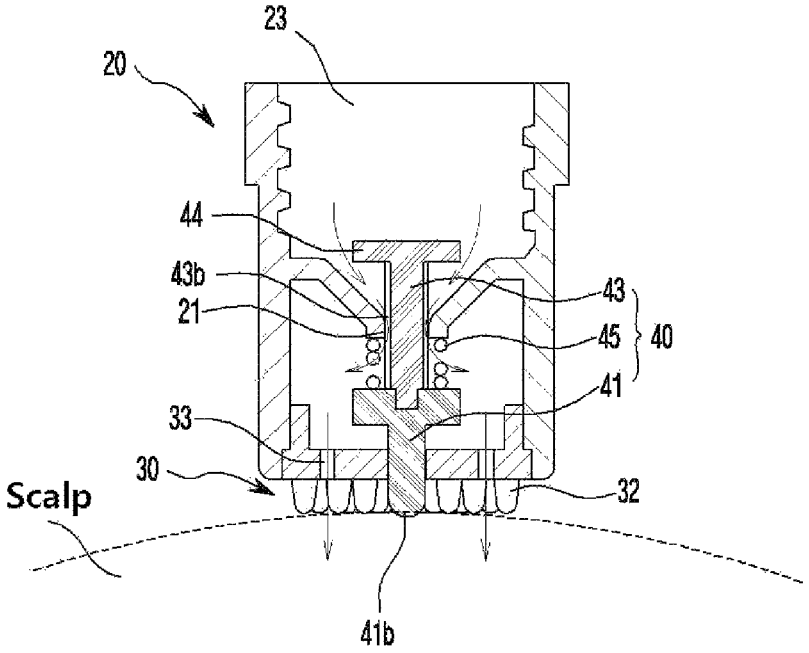

As shown in FIGS. 1 to 6, a container for a hair tonic having scalp stimulation protrusions of the present invention includes: a container main body 10 containing hair tonic therein; a lid 20 coupled to the upper portion of the container main body; a scalp stimulation means 30 coupled to the upper portion of the lid; and a nozzle opening and closing means 40 coupled at the centers of the lid and the scalp stimulation means and configured to protrude above the scalp stimulation means.

The lid 20 is provided therein with a partition wall 22 with a nozzle hole 21 formed at the center thereof. Here, the inner space of the lid is partitioned into upper and lower spaces by the partition wall, wherein the lower portion of the lid is provided with a container coupling portion 23 for being coupled to the container main body, and the upper portion thereof is provided with a coupling grooved portion 24 for being coupled to the scalp stimulation means 30.

The scalp stimulation means 30 is protrudingly provided on the upper portion thereof with a plurality of scalp stimulation protrusions 32 for preventing hair loss and promoting hair growth by promoting blood circulation and medicinal fluid absorption while stimulating the scalp when tapping the scalp. Further, an assembly hole 31 is formed at the center of the scalp stimulation means, and a plurality of medicinal fluid discharge holes 33 are formed outside the assembly hole so as to disperse and discharge the medicinal fluid.

Herein, although the upper portion of the scalp stimulation means 30 is formed in a planar shape so that the scalp stimulation protrusions 32 have the same height in the embodiment, the scalp stimulation means may be configured in various structures and shapes, and it is preferable that the stimulation means be formed into a structure capable of effectively stimulating the scalp by tapping the scalp.

The nozzle opening and closing means 40 is provided to protrude above the scalp stimulation means by being inserted through both the nozzle hole 21 of the lid and the assembly hole 31 of the scalp stimulation means, so as to be operated under pressure while compressing an elastic spring when the scalp is tapped. Here, the partition wall 22 of the lid is provided at a position around the nozzle hole with an inclined portion 21*a* having a taper shape, and a lower portion of the nozzle opening and closing means is provided with a blocking plate 44 such that an outer edge of the blocking plate (an edge where the vertical and horizontal surfaces of the perimeter meet together) is normally in linear contact with the inclined portion for tight sealing, but nozzle opening operation is quickly performed when the nozzle opening and closing means is operated under pressure.

In other words, by the nozzle opening operation of the nozzle opening and closing means 40, the medicinal fluid is dispersed in all directions through the plurality of medicinal fluid discharge holes 33 formed at the circumference of the scalp stimulation means after passing through the nozzle hole 21 of the inclined portion 21*a* provided at the center of the lid.

In particular, the nozzle opening and closing means 40 includes: a first member 41 inserted through the assembly hole of the scalp stimulation means; and a second member 43 inserted through the nozzle hole 21 of the lid and provided with the blocking plate 44 at a lower portion thereof, the first and second members being coupled together to be arranged on top of one another. Further, the elastic spring 45 is placed between a lower portion of the first member 41 and the partition wall 22 inside the lid to elastically support the first member.

Here, a coupling groove 41*a* is formed at the lower portion of the first member, and a coupling protrusion 43*a* is correspondingly formed at the upper portion of the second member to be inserted in the coupling groove, so that the first and second members 41 and 43 are coupled together.

Further, the second member 43 is provided with medicinal fluid discharge guide grooves 43*b* for dispersing and discharging the medicinal fluid in vertical directions. Here, the medicinal fluid discharge guide grooves 43*b* are formed at circumferentially equiangular positions on an outer circumferential surface of the second member 43.

In the drawings, reference numeral 41*b* denotes a pressing portion formed at the upper portion of the first member 41 protruding above the scalp stimulation means.

Hereinafter, the operation and effect of the present invention configured as described above will be described.

Firstly, describing the assembly process of the present invention, the second member 43 of the nozzle opening and closing means is inserted into the nozzle hole 21 of the lid 20 from below the nozzle hole 21 to be coupled to the first member 41 at a position above the nozzle hole in a manner such that the first and second members 41 and 43 are arranged on top of one another.

Here, the elastic spring 45 is placed between the lower portion of the first member 41 and the partition wall 22 of the lid.

In this state, the scalp stimulation means 30 is fitted in the coupling grooved portion 24 at the upper portion of the lid 20, wherein the pressing portion 41*b* at the upper portion of the first member is assembled to protrude through the assembly hole 31 formed at the center of the scalp stimulation means.

After assembling the parts as described above, the container coupling portion 23 of the lid is coupled to the upper portion of the container main body 10 containing hair tonic, thereby completing assembly.

The present invention assembled as described above is used by lightly tapping scalp with the scalp stimulation means 30 while positioning the container upside down.

As described above, when the scalp is tapped with the scalp stimulation means 30, the scalp stimulation protrusions 32 at the upper portion of the scalp stimulation means help blood circulation by stimulating the scalp.

Simultaneously, the first member 41 of the nozzle opening and closing means protruding above the scalp stimulation means 30 is pressed and moved down while compressing the elastic spring 45, and accordingly, the second member 43 coupled to the lower portion of the first member is also moved down.

As the second member 43 of the nozzle opening and closing means is moved down as described above, nozzle opening operation is quickly performed in response to movement of the nozzle opening and closing means under pressure. Before the nozzle opening operation, the outer edge of the blocking plate 44 is in linear contact with the inclined portion 21*a*, thus maintaining tight sealing effect.

As described above, when the nozzle opening operation is performed by downward movement of the blocking plate 44 away from the inclined portion 21*a* around the nozzle hole at the lower portion of the nozzle opening and closing means, the hair tonic in the container main body 10 is discharged to the nozzle hole 21 through the inclined portion 21*a* at the center of the lid. In conventional art, the top of nozzle hole is formed horizontally, and so a medicinal fluid is not quickly discharged if the medicinal fluid has a slight viscosity like hair tonic. In this invention, even if a medicinal fluid has a viscosity, the medicinal fluid is quickly discharged by the immediate opening of line contact between the blocking plate and the inclined portion.

And then a medicinal fluid is dispersed in all directions through the medicinal fluid discharge holes 33 formed at the outer edge of the scalp stimulation means to be evenly applied to the scalp.

In particular, since the second member 43 of the nozzle opening and closing means inserted in the nozzle hole 21 of the lid is formed with the medicinal fluid discharge guide grooves 43*b* in vertical directions at circumferentially equiangular positions, the medicinal fluid discharged to the nozzle hole 21 is dispersed and discharged in all directions by the guide grooves 43*b*, thus being efficiently supplied to the medicinal fluid discharge holes 33 formed at the outer edge of the scalp stimulation means.

Further, when the container is lifted to remove the external force pressing the first member 41 of the nozzle opening and closing means, the first member is returned to the original position thereof by being moved up due to the resilience of the elastic spring 45, and the second member 43 coupled to the lower portion of the first member is also moved up and is returned to the original position thereof. Therefore, the blocking plate 44 of the lower portion of the second member is brought into close contact with the inclined portion 21*a* outside the nozzle hole 21, thereby tightly sealing the container.

In particular, as the outer edge of the blocking plate 44 of the lower portion of the second member is in linear contact with the inclined portion 21*a* having the taper shape formed outside the nozzle hole 21, sealing operation is quickly performed. Due to the ensuring of the sealing operation, it is possible to prevent the medicinal fluid from leaking as well as possible to discharge a predetermined amount of medicinal fluid.

According to the number of operations of tapping the scalp with the scalp stimulation means 30 by a user, the nozzle opening operation is performed by the vertically moving first and second members 41 and 43 of the nozzle opening and closing means so that it is possible to repeatedly discharge a predetermined amount of medicinal fluid.

Accordingly, the present invention is configured such that when the nozzle opening and closing means 40 provided at the centers of both the lid 20 coupled to the upper portion of the container main body 10 and the scalp stimulation means 30 coupled to the upper portion of the lid taps the scalp, the nozzle opening and closing means is pressed and the medicinal fluid is discharged. Here, the blocking plate 44 of the lower portion of the nozzle opening and closing means is normally in linear contact with the inclined portion 21*a* outside the nozzle hole, thus preventing the medicinal fluid from leaking. However, when the nozzle opening and closing means taps the scalp, nozzle opening operation is quickly performed so as to discharge the medicinal fluid. Thus, not only the medicinal fluid is smoothly discharged to the scalp but also is dispersed and evenly discharged in all directions through the medicinal fluid discharge holes 33 of the scalp stimulation means, whereby use efficiency is greatly improved compared to the conventional one.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A container for a hair tonic, in which the container is provided with scalp stimulation protrusions that stimulate a scalp while discharging a medicinal fluid as a nozzle hole is opened by tapping a scalp stimulation means provided at an upper portion of a lid coupled to an upper portion of a container main body (10) on the scalp, wherein the nozzle hole (21) is formed at a center of a partition wall (22) inside the lid (20);

the scalp stimulation means (30) is coupled to the upper portion of the lid and comprises an assembly hole (31) formed at a center of the scalp stimulation means, a plurality of said scalp stimulation protrusions (32) protrudingly provided on the scalp stimulation means, and medicinal fluid discharge holes (33) formed outside the assembly hole so as to disperse and discharge the medicinal fluid; and a nozzle opening and closing means (40) protrudes above the scalp stimulation means (30) through both the nozzle hole (21) of the lid and the assembly hole (31) of the scalp stimulation means, the nozzle opening and closing means (40) being insertedly provided in the lid (20) to be operated under pressure while compressing an elastic spring when tapping the scalp stimulation means on the scalp, wherein the partition wall (22) of the lid is provided at a position around the nozzle hole with an inclined portion (21*a*) having a taper shape, and a lower portion of the nozzle opening and closing means is provided with a blocking plate (44) such that an outer edge of the blocking plate is normally in linear contact with the inclined portion for tight sealing, and a nozzle opening operation is quickly performed when the nozzle opening and closing means is operated under pressure.

2. The container of claim 1, wherein the nozzle opening and closing means (40) includes: a first member (41) inserted through the assembly hole (31) of the scalp stimulation means; and a second member (43) inserted through the nozzle hole (21) of the lid and provided with the blocking plate (44) at a lower portion thereof, the first and second members being coupled together to be arranged on top of one another, and the elastic spring (45) is placed between a lower portion of the first member (41) and the partition wall (22) inside the lid to elastically support the first member.

3. The container of claim 2, wherein the second member (43) is provided at circumferentially equiangular positions on an outer circumferential surface thereof with medicinal fluid discharge guide grooves (43*b*) for dispersing and discharging the medicinal fluid in vertical directions.

* * * * *